US012616249B2

(12) United States Patent
Qi et al.

(10) Patent No.: US 12,616,249 B2
(45) Date of Patent: May 5, 2026

(54) VAPOR GENERATION DEVICE

(71) Applicant: SHENZHEN FIRST UNION TECHNOLOGY CO., LTD., Shenzhen City (CN)

(72) Inventors: Zuqiang Qi, Shenzhen City (CN); Weifeng Gong, Shenzhen City (CN); Jiamao Luo, Shenzhen City (CN); Baoling Lei, Shenzhen City (CN); Zhongli Xu, Shenzhen City (CN); Yonghai Li, Shenzhen City (CN)

(73) Assignee: SHENZHEN FIRST UNION TECHNOLOGY CO., LTD., Shenzhen City (CN)

( * ) Notice: Subject to any disclaimer, the term of this patent is extended or adjusted under 35 U.S.C. 154(b) by 617 days.

(21) Appl. No.: 18/015,959

(22) PCT Filed: Jul. 14, 2021

(86) PCT No.: PCT/CN2021/106313
§ 371 (c)(1),
(2) Date: Jan. 13, 2023

(87) PCT Pub. No.: WO2022/012599
PCT Pub. Date: Jan. 20, 2022

(65) Prior Publication Data

US 2024/0016217 A1 Jan. 18, 2024

(30) Foreign Application Priority Data

Jul. 14, 2020 (CN) ..... 202021386153.1

(51) Int. Cl.
*A24F 40/465* (2020.01)
*A24F 40/48* (2020.01)

(52) U.S. Cl.
CPC ..... *A24F 40/465* (2020.01); *A24F 40/48* (2020.01)

(58) Field of Classification Search
CPC ..... A24F 40/20; A24F 40/46; A24F 40/465; A24F 40/48
See application file for complete search history.

(56) References Cited

U.S. PATENT DOCUMENTS 5,388,594 A 2/1995 Counts et al.
2007/0256697 A1 11/2007 Yang
(Continued)

FOREIGN PATENT DOCUMENTS

CN 104799434 A 7/2015
CN 104770895 B * 8/2017 ..... A24F 40/46
(Continued)

OTHER PUBLICATIONS

CN104770895b, machine translation (Year: 2017).*

*Primary Examiner* — Michael H. Wilson
*Assistant Examiner* — Stephanie Lynn Moore
(74) *Attorney, Agent, or Firm* — Scully, Scott, Murphy & Presser, P.C.

(57) ABSTRACT

A vapor generation device includes a housing. The housing includes a near end and a far end opposite to each other in a length direction, the near end being provided with a first opening, and the far end being provided with a second opening. The housing is internally provided with: a cavity, located between the first opening and the second opening; and a heater, extending in an axial direction of the cavity and surrounding at least a part of the cavity, and configured to heat an inhalable material received in the cavity, at least a part of the heater close to the far end including an inner diameter-reduced region, to provide a stop for the inhalable material received in the cavity during use. In the foregoing vapor generation device, an inner diameter-reduced part of
(Continued)

the heater abuts against the inhalable material to provide support.

20 Claims, 4 Drawing Sheets

(56) References Cited

U.S. PATENT DOCUMENTS

| | | | | |
|---|---|---|---|---|
| 2017/0119050 | A1* | 5/2017 | Blandino | H05B 3/0014 |
| 2019/0166918 | A1* | 6/2019 | Thorsen | A24F 40/50 |
| 2023/0225411 | A1* | 7/2023 | Batista | H05B 6/108 131/328 |

FOREIGN PATENT DOCUMENTS

| | | | |
|---|---|---|---|
| CN | 107809919 | A | 3/2018 |
| CN | 108882751 | A | 11/2018 |
| CN | 109076649 | A | 12/2018 |
| CN | 109330030 | A | 2/2019 |
| CN | 209002927 | U | 6/2019 |
| CN | 213344346 | U | 6/2021 |
| DE | 202016106568 | U1 | 4/2018 |
| DE | 102017222528 | B3 | 1/2019 |
| WO | 2018/019786 | A1 | 2/2018 |
| WO | 2019/101947 | A1 | 5/2019 |

* cited by examiner

VAPOR GENERATION DEVICE

CROSS-REFERENCE TO RELATED APPLICATIONS

This application is a 35 U.S.C. § 371 National Phase conversion of International (PCT) Patent Application No. PCT/CN2021/106313, filed on Jul. 14, 2021, which claims priority to Chinese Patent Application No. 202021386153.1, filed with the China National Intellectual Property Administration on Jul. 14, 2020 and entitled "VAPOR GENERATION DEVICE", which is incorporated herein by reference in its entirety. The PCT International Patent Application was filed and published in Chinese.

TECHNICAL FIELD

This application relates to the field of heat-not-burn e-cigarette device technologies, and in particular, to a vapor generation device.

BACKGROUND

Tobacco products (such as cigarettes and cigars) burn tobacco during use to produce tobacco smoke. Attempts are made to replace these tobacco-burning products by manufacturing products that release compounds without being burnt.

An example of the products is a heating device that releases a compound by heating rather than burning a material. For example, the material may be tobacco or other non-tobacco products, where the non-tobacco products may or may not contain nicotine. As the related art, there is a heating device for heating a tobacco product by peripheral heating provided in Invention Patent No. 201680037678.4. Specifically, the heating device heats, through a tubular heater, tobacco products accommodated in a tubular hollow of the heater. The heating device is provided with a hollow tube extending into the tubular heater, a front end of the tobacco product inserted into the tubular heater abuts against the hollow tube to be fixed, and the condensate of an aerosol drops onto the hollow tube and then seeps out of a housing, which causes pollution.

SUMMARY

To solve the problem of condensate pollution in the related art, embodiments of this application provide a vapor generation device, configured to heat an inhalable material to generate an aerosol for inhalation, the vapor generation device including a housing, including a near end and a far end opposite to each other in a length direction, the near end being provided with a first opening, and the far end being provided with a second opening; where the housing is internally provided with: a cavity, located between the first opening and the second opening, the inhalable material being removably received in the cavity through the first opening, and the second opening being configured for external air to enter the cavity; and a heater, located between the first opening and the second opening, constructed to extend in an axial direction of the cavity and surround at least a part of the cavity, and configured to heat the inhalable material received in the cavity, at least a part of the heater close to the far end including an inner diameter-reduced region, to provide a stop for the inhalable material received in the cavity during use.

In the foregoing vapor generation device, an inner diameter-reduced part of the heater abuts against the inhalable material to provide support. In this way, scraps or condensate flowing out of an end portion of the inhalable material can be at least partially received by the inner diameter-reduced part of the heater to be re-vaporized, thereby reducing the pollution caused by direct seepage of the condensate.

In a more exemplary implementation, the vapor generation device further includes: a hollow tube, located between the heater and the second opening, and providing an airflow path between the second opening and the cavity, the hollow tube being constructed to surround at least a part of the heater close to the far end, and provide support for the heater.

In a more exemplary implementation, an outer surface of the at least a part of the heater close to the far end is provided with a groove extending in an axial direction of the heater; and an inner wall of the hollow tube is provided with a convex edge at least partially extending into the groove, to prevent the heater from rotating around a central axis.

In a more exemplary implementation, the hollow tube includes a first part close to the heater in an axial direction, and a second part close to the second opening in the axial direction; and an inner diameter of the first part is greater than an inner diameter of the second part.

In a more exemplary implementation, the hollow tube further includes a third part located between the first part and the second part; and an inner diameter of the third part gradually decreases in a direction toward the second part.

In a more exemplary implementation, an end portion of the heater close to the far end abuts against an inner wall of the third part, to form a stop.

In a more exemplary implementation, an end portion of the heater close to the far end is constructed to gradually contract inwardly to form the inner diameter-reduced region.

In a more exemplary implementation, the heater is an induction heater capable of being penetrated by a changing magnetic field to generate heat, to heat the inhalable material, the heater including: a first heating section and a second heating section sequentially arranged in the axial direction, to facilitate independent heating of different parts of the inhalable material; a first metal material, connected to the first heating section; a second metal material, connected to the second heating section; and a third metal material, having a material different from that of the first metal material and the second metal material, where a first thermocouple is formed between the first metal material and the third metal material to sense a temperature of the first heating section, and a second thermocouple is formed between the second metal material and the third metal material to sense a temperature of the second heating section.

In a more exemplary implementation, the heater further includes a third heating section located between the first heating section and the second heating section; and the third heating section basically avoids the changing magnetic field, and generates heat by receiving heat transferred from the first heating section and the second heating section to heat the inhalable material.

In a more exemplary implementation, the third metal material is connected to the third heating section.

BRIEF DESCRIPTION OF THE DRAWINGS

One or more embodiments are exemplarily described with reference to the corresponding figures in the accompanying drawings, and the descriptions are not to be construed as limiting the embodiments. Elements in the accompanying drawings that have same reference numerals are represented as similar elements, and unless otherwise particularly stated, the figures in the accompanying drawings are not drawn to scale.

DETAILED DESCRIPTION

For ease of understanding of this application, this application is described in further detail below with reference to the accompanying drawings and specific implementations.

Figure 1:
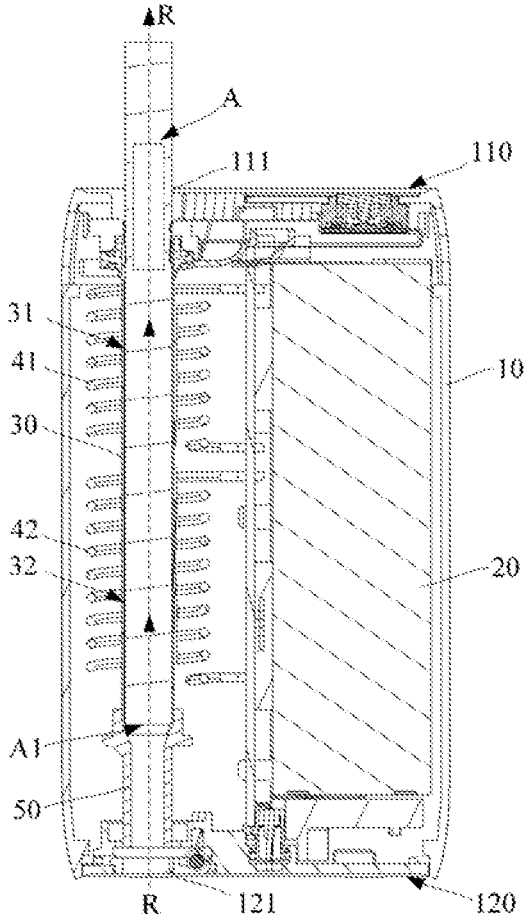
FIG. 1 is a schematic diagram of a vapor generation device according to an embodiment of this application.

An embodiment of this application provides a vapor generation device, a structure thereof may be shown in FIG. 1. The vapor generation device is configured to receive and heat an inhalable material A, such as a cigarette, to make at least one volatile component of the inhalable material be volatilized to form an aerosol for inhalation. Base on functional requirements, structural and functional components include:

- a housing 10, an overall shape of which is square substantially, that is, a dimension in a length direction being greater than a dimension in a width direction, and the dimension in the width direction being greater than a dimension in a thickness direction. The housing 10 includes a near end 110 and a far end 120 opposite to each other in the length direction, and during use, the near end 110 is used as an end portion brought close to a user for performing the inhalation and operation of the inhalable material A.

Further, the near end 110 is provided with a first opening 111, and during use, the inhalable material A can be received in the housing 10 through the first opening 111 to be heated or removed from the housing.

The far end 120 is provided with a second opening 121 opposite to the first opening 111. On the one hand, the second opening 121 is used as an air inlet for external air to enter during an inhalation process, and can further be used as a cleaning port for cleaning an interior of the housing 10 by a cleaning tool such as a thin stick or an iron wire extending into the housing 10.

Further, a cavity for receiving the inhalable material A is formed between the first opening 111 and the second opening 121 in the housing 10. The housing 10 is further internally provided with:

- a core 20 for supplying power; and
- a heater 30, constructed into a tubular shape surrounding at least a part of the cavity. In an exemplary embodiment shown in FIG. 1, the heater 30 is an induction heater penetrated by a changing magnetic field to generate heat, to heat the inhalable material A.

In the implementation in FIG. 1, the housing 10 is further internally provided with:

- a first induction coil 41, surrounding a first heating section 31 of the heater 30 close to the near end 110 in the length direction; and a second induction coil 42, surrounding a second heating section 32 of the heater 30 close to the far end 120 in the length direction. In this way, during use, the first heating section 31 can generate heat by independently starting the first induction coil 41, to heat a part of the inhalable material A surrounded by the first heating section 31; or the second heating section 32 can generate heat by independently starting the second induction coil 42, to heat a part of the inhalable material A surrounded by the second heating section 32.

Further referring to the exemplary implementation shown in FIG. 1, a hollow tube 50 is further arranged between the second opening 121 and the heater 30. The hollow tube 50 is configured to provide support for an end portion of the heater 30 close to the far end 120, and provide an airflow path for external air to enter the inhalable material A through the second opening 121 during inhalation.

In addition, during the inhalation process, as shown by an arrow R in FIG. 1, an airflow enters via the second opening 121, then flows into the inhalable material A received in the heater 30 through the hollow tube 50, and then penetrates the inhalable material A and carries the generated aerosol to a suction nozzle end of the near end 110 for inhalation.

Figure 3:
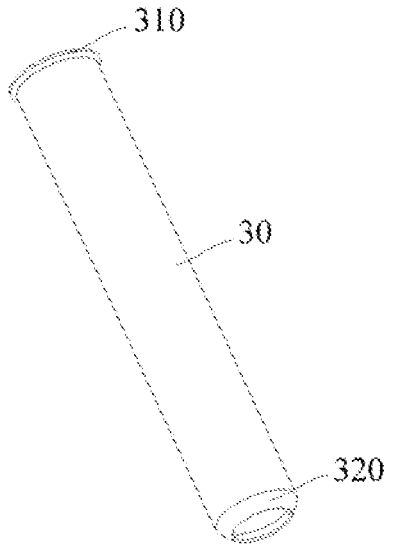
FIG. 3 is a schematic structural diagram of a heater in FIG. 1 in a three-dimensional perspective.

Further referring to FIG. 1 and FIG. 3, in an exemplary implementation of this application, the heater 30 includes an upper end 310 close to the near end 110 and a lower end 320 close to the far end 120 in the length direction. In addition, at least a part of the heater 30 close to the lower end 320 is in an inwardly contracted shape, and forms a portion that reduces an inner diameter of the cavity after mounting, and this portion is configured to make a front end A1 of the inhalable material A received in the cavity abut against a contraction portion of the heater 30 to form a stop.

In this way, the scraps dropped from the front end A1 or the condensate between a part close to the front end A1 and the heater 30 may at least first fall on the contraction portion of the heater 30 to be received and re-vaporized, thereby reducing the pollution caused by direct drop or seepage.

Further, at least a part of the heater 30 close to the lower end 320 is arranged in a manner of being inserted into the hollow tube 50, or surrounded by the hollow tube 50. This arrangement is to prevent the problem that the condensate or scraps of the aerosol on an inner wall of the heater 30 directly falls out along a hollow and an inner wall of the hollow tube 50 when a manner in which the hollow tube 50 is extended into the heater 30 is adopted.

Figure 2:
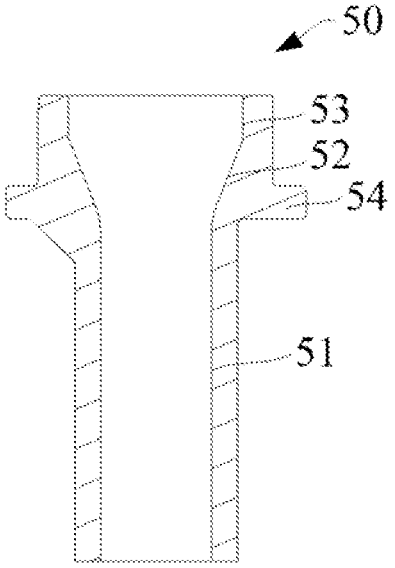
FIG. 2 is a schematic diagram of a cross-sectional structure of a hollow tube in FIG. 1.

Referring to FIG. 1 and FIG. 2, a structure of the hollow tube 50 includes:

- a first part 51 close to the second opening 121;
- a second part 53 close to and surrounding the heater 30, and certainly, according to FIG. 2, an inner diameter of the second part 53 being greater than an inner diameter of the first part 51; and
- a third part 52, located between the first part 51 and the second part 53, constructed into a design of a gradually reduced inner diameter to make an inner wall thereof inclined, for the lower end 320 of the heater 30 to abut against.

In addition, in order to facilitate the fixation and holding of the hollow tube 50 itself in the housing 10, an extension part 54 extending outward in a radial direction is further provided. The extension part 54 may abut against some supporting walls arranged on the housing 10, thereby allowing the hollow tube 50 itself to be stably mounted.

Further referring to FIG. 3, the upper end 310 of the heater 30 is constructed as a wide mouth with a gradually increased diameter, which can facilitate the provision of incline guidance when the inhalable material A is inserted into the heater 30. In addition, the design of the wide mouth of the upper end 310 in FIG. 3 makes an outer diameter of a wall of the upper end 310 relatively greater than that of other portions. In this way, components or structures such as a supporting holder may be arranged at the upper end to support the upper end 310 of the heater 30. If the components or structures such as the holder is in an annular shape at least partially surrounding the heater 30, a certain gap may be left between the holder and the heater to form an air layer for heat insulation.

Figure 4:
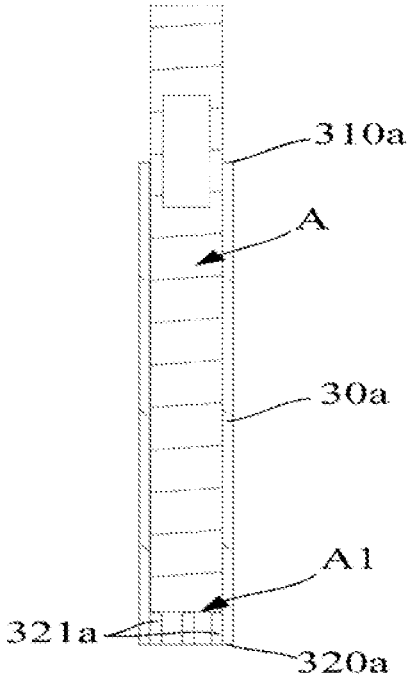
FIG. 4 is a schematic structural diagram of a heater according to another embodiment.
Figure 5:
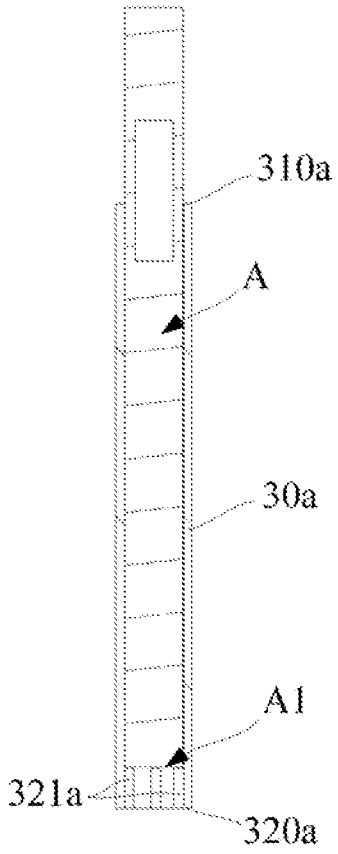
FIG. 5 is a schematic diagram of an inhalable material received in the heater in FIG. 4 and forming a stop.

FIG. 4 and FIG. 5 provide a heater 30*a* according to another embodiment. The heater includes an upper end 310*a* close to the near end 110 and a lower end 320*a* close to the far end 120 in the length direction. At least a part of a tube wall of the heater 30*a* close to the lower end 320*a* is provided with one or more grooves 321*a*.

In an exemplary implementation, the groove 321*a* is formed by punching or pressing the heater 30*a* made of a metal induction material, or by other manners. In FIG. 4 and FIG. 5, the groove 321*a* extends in a length direction of the heater 30*a*.

The groove 321*a* makes a part of an inner wall of the heater 30*a* close to the lower end 320*a* in a protruding shape, thereby reducing the inner diameter of the cavity. When the inhalable material A is received in the heater 30*a*, a front end A1 abuts against the groove 321*a* to form a stop.

Figure 6:
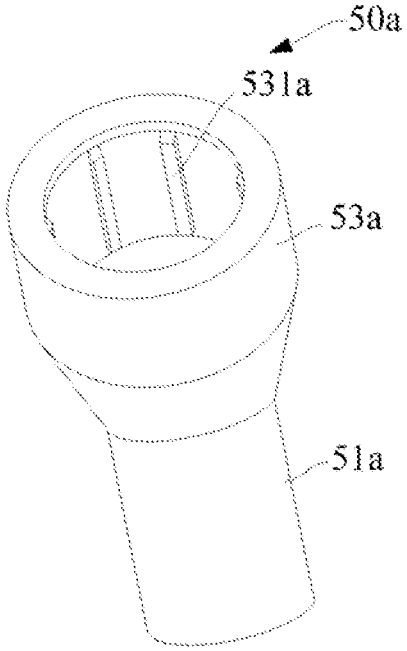
FIG. 6 is a schematic structural diagram of a hollow tube matching and supporting a heater in FIG. 5.

FIG. 6 is a schematic structural diagram of a hollow tube 50*a* matching the heater 30*a*. A structure of the hollow tube 50*a* includes a first part 51*a* close to the second opening 121 and a second part 53*a* close to and surrounding the heater 30*a*. An inner wall of the second part 53*a* of the hollow tube 50*a* for surrounding the heater 30*a* or being inserted by the heater 30*a* is provided with one or more convex edges 531*a*. The convex edge 531 is configured to project or protrude into the groove 321*a* when a part of the lower end 320*a* of the heater 30*a* is inserted, thereby preventing the heater 30*a* from rotating around a central axis, and preventing components such as thermocouple wires or wires connected thereto from being torn off.

Figure 7:
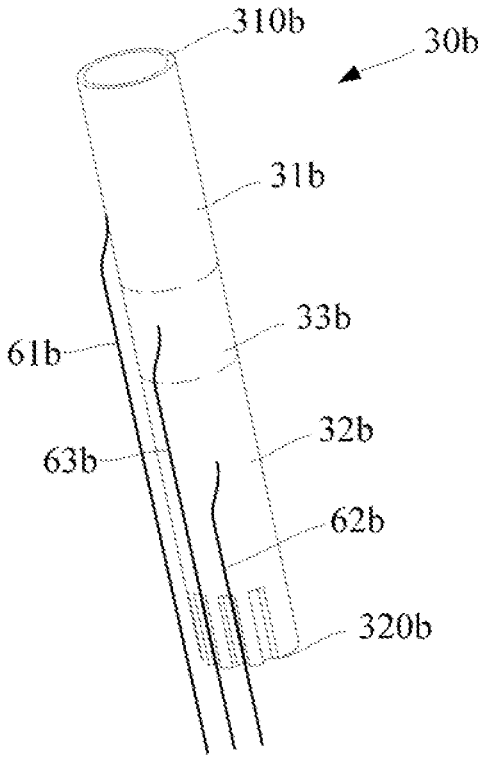
FIG. 7 is a schematic structural diagram of a heater according to another embodiment.

FIG. 7 shows a structure of a heater 30*b* according to another exemplary implementation. The heater 30*b* includes a first heating section 31*b* close to an upper end 310*b* and a second heating section 32*b* close to a lower end 320*b*. During use, the first heating section 31*b* and the second heating section 32*b* may be independently and/or sequentially started, and then independently and/or sequentially heat different parts of the inhalable material A received in the heater 30*b*.

The heater 30*b* further includes a third heating section 33*b* located between the first heating section 31*b* and the second heating section 32*b*. After mounting, the third heating section 33*b* avoids the first induction coil 41 and the second induction coil 42. Therefore, a magnetic field strength of a position of the third heating section 33*b* is lower than that of the first heating section 31*b* and the second heating section 32*b*, and a part of the inhalable material A located in this position can be heated by receiving heat transferred by the first heating section 31*b* and the second heating section 32*b*.

A first metal material 61*b* is connected to an outer wall of the first heating section 31*b;* a second metal material 62*b* is connected to an outer wall of the second heating section 32*b*; and a third metal material 63*b* is connected to an outer wall of the third heating section 33*b*. In an implementation, each of the first metal material 61*b*, the second metal material 62*b* and the third metal material 63*b* may adopt a galvanic material such as one of iron, nickel-chromium alloy, nickel-silicon alloy, nickel-chromium-copper, constant bronze or iron-chromium alloy.

Further, in the implementation, the first metal material 61*b* and the third metal material 63*b* are made of different materials. In this way, a thermocouple capable of sensing a temperature of the first heating section 31*b* may be formed between the first metal material 61*b* and the third metal material 63*b*.

Similarly, the second metal material 62*b* and the third metal material 63*b* are made of different materials. In this way, a thermocouple capable of sensing a temperature of the second heating section 32*b* may be formed between the second metal material 62*b* and the third metal material 63*b*.

Based on a fact that only two ends of the thermocouple need to be made of different materials, the first metal material 61*b* and the second metal material 62*b* may be the same.

In addition, a portion where the third metal material 63*b* is connected to the heater 30*b* may not be limited, for example, the connection may be at any position of the heater 30*b*. In the exemplary implementation of FIG. 7, the third metal material 63*b* is welded on an outer wall of the third heating section 33*b*.

In the exemplary implementation shown in FIG. 7, the first metal material 61*b*, the second metal material 62*b* and the third metal material 63*b* are constructed into elongated electrical pins, and can be fixedly connected to a portion corresponding to the heater 30*a* by welding or the like.

For example, in the implementation, the third metal material 63*b*, used as a positive electrode of the thermocouple, adopts a nickel-chromium alloy material, and the first metal material 61*b* and the second metal material 62*b*, used as a negative electrode of the thermocouple, adopt a nickel-silicon alloy material. In this way, a K-type thermocouple is formed between the first metal material 61*b* and the third metal material 63*b* to sense the temperature of the first heating section 31*b*, and a K-type thermocouple is formed between the first metal material 61*b* and the second metal material 62*b* to sense the temperature of the second heating section 32*b*.

In other implementation variations, the foregoing heater 30/30*a*/30*b* may be a resistance heater or an infrared emitter. The resistance heater may be obtained by forming conductive traces on a tubular electrically insulating substrate such as a ceramic tube, a PI (polyimide) film, or the like.

The infrared emitter may be obtained by depositing an infrared emitting coating layer on a tubular infrared transparent substrate such as a quartz tube, or by wrapping an infrared emitting film. The infrared emitter can heat the inhalable material A accommodated therein by radiating infrared rays.

It should be noted that, the specification of this application and the accompanying drawings thereof illustrate exemplary embodiments of this application, but this application is not limited to the embodiments described in the specification. Further, a person of ordinary skill in the art may make improvements or variations according to the above descriptions, and such improvements and variations shall all fall within the protection scope of the appended claims of this application.

What is claimed is:

1. A vapor generation device, configured to heat an inhalable material to generate an aerosol for inhalation, the device comprising a housing, comprising a near end and a far end opposite to each other in a length direction, the near end being provided with a first opening, and the far end being provided with a second opening; wherein the housing is internally provided with:

a cavity, located between the first opening and the second opening, the inhalable material being removably received in the cavity through the first opening, and the second opening being configured for external air to enter the cavity; and a heater, located between the first opening and the second opening, constructed to extend in an axial direction of the cavity and surround at least a part of the cavity, and configured to heat the inhalable material received in the cavity, at least a part of the heater close to the far end comprising an inner diameter-reduced region configured to be a stop of the inhalable material moved in the cavity so that the inhalable material stays outside the inner diameter reduced region, the inner diameter reduced region further configured to receive and re-vaporize direct drops from the inhalable material after the inhalable material is heated.

2. The vapor generation device according to claim 1, further comprising:

a hollow tube, located between the heater and the second opening, and providing an airflow path between the second opening and the cavity, the hollow tube being constructed to surround at least a part of the heater close to the far end and provide support for the heater.

3. The vapor generation device according to claim 2, wherein an outer surface of the at least a part of the heater close to the far end is provided with a groove extending in an axial direction of the heater; and an inner wall of the hollow tube is provided with a convex edge at least partially extending into the groove, to prevent the heater from rotating around a central axis.

4. The vapor generation device according to claim 2, wherein the hollow tube comprises a first part close to the heater in an axial direction, and a second part close to the second opening in the axial direction; and an inner diameter of the first part is greater than an inner diameter of the second part.

5. The vapor generation device according to claim 4, wherein the hollow tube further comprises a third part located between the first part and the second part; and an inner diameter of the third part gradually decreases in a direction toward the second part.

6. The vapor generation device according to claim 5, wherein an end portion of the heater close to the far end abuts against an inner wall of the third part, to form a stop.

7. The vapor generation device according to claim 1, wherein an end portion of the heater close to the far end is constructed to gradually contract inwardly to form the inner diameter-reduced region.

8. The vapor generation device according to claim 1, wherein the heater is an induction heater capable of being penetrated by a changing magnetic field to generate heat, to heat the inhalable material;

the heater comprising:

a first heating section and a second heating section sequentially arranged in the axial direction, to facilitate independent heating of different parts of the inhalable material;

a first metal material, connected to the first heating section;

a second metal material, connected to the second heating section; and a third metal material, having a material different from that of the first metal material and the second metal material, wherein a first thermocouple is formed between the first metal material and the third metal material to sense a temperature of the first heating section, and a second thermocouple is formed between the second metal material and the third metal material to sense a temperature of the second heating section.

9. The vapor generation device according to claim 8, wherein the heater further comprises a third heating section located between the first heating section and the second heating section; and the third heating section avoids the changing magnetic field, and generates heat by receiving heat transferred from the first heating section and the second heating section to heat the inhalable material.

10. The vapor generation device according to claim 9, wherein the third metal material is connected to the third heating section.

11. The vapor generation device according to claim 3, wherein the hollow tube comprises a first part close to the heater in an axial direction, and a second part close to the second opening in the axial direction; and an inner diameter of the first part is greater than an inner diameter of the second part.

12. The vapor generation device according to claim 11, wherein the hollow tube further comprises a third part located between the first part and the second part; and an inner diameter of the third part gradually decreases in a direction toward the second part.

13. The vapor generation device according to claim 12, wherein an end portion of the heater close to the far end abuts against an inner wall of the third part, to form a stop.

14. The vapor generation device according to claim 2, wherein an end portion of the heater close to the far end is constructed to gradually contract inwardly to form the inner diameter-reduced region.

15. The vapor generation device according to claim 3, wherein an end portion of the heater close to the far end is constructed to gradually contract inwardly to form the inner diameter-reduced region.

16. The vapor generation device according to claim 2, wherein the heater is an induction heater capable of being penetrated by a changing magnetic field to generate heat, to heat the inhalable material;

the heater comprising:

a first heating section and a second heating section sequentially arranged in the axial direction, to facilitate independent heating of different parts of the inhalable material;

a first metal material, connected to the first heating section;

a second metal material, connected to the second heating section; and a third metal material, having a material different from that of the first metal material and the second metal material, wherein a first thermocouple is formed between the first metal material and the third metal material to sense a temperature of the first heating section, and a second thermocouple is formed between the second metal material and the third metal material to sense a temperature of the second heating section.

17. The vapor generation device according to claim 16, wherein the heater further comprises a third heating section located between the first heating section and the second heating section; and the third heating section avoids the changing magnetic field, and generates heat by receiving heat transferred from the first heating section and the second heating section to heat the inhalable material.

18. The vapor generation device according to claim 17, wherein the third metal material is connected to the third heating section.

19. The vapor generation device according to claim 3, wherein the heater is an induction heater capable of being penetrated by a changing magnetic field to generate heat, to heat the inhalable material;

the heater comprising:

a first heating section and a second heating section sequentially arranged in the axial direction, to facilitate independent heating of different parts of the inhalable material;

a first metal material, connected to the first heating section;

a second metal material, connected to the second heating section; and a third metal material, having a material different from that of the first metal material and the second metal material, wherein a first thermocouple is formed between the first metal material and the third metal material to sense a temperature of the first heating section, and a second thermocouple is formed between the second metal material and the third metal material to sense a temperature of the second heating section.

20. The vapor generation device according to claim 19, wherein the heater further comprises a third heating section located between the first heating section and the second heating section; and the third heating section avoids the changing magnetic field, and generates heat by receiving heat transferred from the first heating section and the second heating section to heat the inhalable material.

* * * * *